US008408762B2

(12) United States Patent
Chen

(10) Patent No.: US 8,408,762 B2
(45) Date of Patent: Apr. 2, 2013

(54) POST FOR A COMBINED LIGHT FITTING

(76) Inventor: Ching-Hui Chen, Huizhou (CN)

( * ) Notice: Subject to any disclaimer, the term of this patent is extended or adjusted under 35 U.S.C. 154(b) by 126 days.

(21) Appl. No.: 13/109,255

(22) Filed: May 17, 2011

(65) Prior Publication Data

US 2012/0163006 A1 Jun. 28, 2012

(30) Foreign Application Priority Data

Dec. 28, 2010 (CN) ..... 2010 2 0700563

(51) Int. Cl.
*F21S 8/00* (2006.01)

(52) U.S. Cl. ..... 362/431; 362/152; 362/153.1; 256/1; 256/19; 256/59; 256/66

(58) Field of Classification Search ..... 362/152, 362/153.1, 431; 256/1, 19, 59, 66
See application file for complete search history.

(56) References Cited

U.S. PATENT DOCUMENTS 6,722,637 B2 * 4/2004 Burkart et al. ..... 256/1

* cited by examiner

*Primary Examiner* — Stephen F Husar
*Assistant Examiner* — Meghan Dunwiddie
(74) *Attorney, Agent, or Firm* — Jackson IPG PLLC

(57) ABSTRACT

A post for a combined light fitting includes a hollow post body composed of at least two post walls, a connector is installed in at least one end of the post body, the connector is provided with a screw connecting hole for connection with outside. All the post walls constituting the post are made of one piece of fiber plate, and on the surface of the fiber plate, at least one V-shaped groove extending along the direction of its height is formed, the V-shaped groove divides the fiber plate into several post walls, and the respective post wall is turned over inward along the V-shaped groove to form the hollow post. In addition, on the upper side and lower side of the fiber plate, positioning grooves are set along the direction of its width, the positioning grooves are perpendicular to the V-shaped groove, a connector is embedded in each of the two ends of the hollow post composed of various post walls after tuned over, and the base of the connector is embedded in the positioning groove for defining the position of the connector.

4 Claims, 3 Drawing Sheets

POST FOR A COMBINED LIGHT FITTING

FIELD OF THE INVENTION

The present invention relates to the technical field of a light fitting and particularly to a post for a combined light fitting.

BACKGROUND OF THE INVENTION

A Chinese utility model, titled "COMBINED LIGHT FITTING THAT IS CONVENIENT FOR DEMOUNTING AND MOUNTING", has been applied by the applicant previously. This combined light fitting is mainly formed by a post and a partition board. The post is made of the solid wood and provided with a hole at the end for connection with the upper portion to satisfy the requirement of use in different heights. However, the solid wood post used for the combined light fitting that has the above described structure has disadvantages as follows: (1) the post of the light fitting is made of the solid wood, which will expend a large amount of wood, the environmental protection can not be realized and the manufacture cost is increased; (2) it is different to satisfy the requirement of mechanized volume production, under the limitation of the properties of materials of the wood itself and the process conditions; (3) the solid wood post also has some restrictions on transmission and mounting, etc.

SUMMARY OF THE INVENTION

The object of the invention is to overcome the disadvantages existing in the above mentioned technique and provide a post used for a combined light fitting, which is prevented from using the solid wood materials and has the advantages of protecting environment and low cost, in addition, this post meets the requirement of mechanized volume production and is light and convenient for transmission and mounting.

The object of the invention may be realized as follows:

a post for a combined light fitting, characterized in that the post is a hollow post body composed of at least two post walls, a connector is installed in at least one end of the post body, the connector is provided with a screw connecting hole for connection with outside; this post for the light fitting is made of at least two post walls (relatively thin in thickness), which forms a hollow post body, instead of the solid wood post, and a screw connecting hole for connection with outside is installed in the end of the hollow post body, which makes it possible for people to connect two or more hollow post bodies together through bolts, this can satisfy the requirement of the light fitting for use in different heights and completely replace the solid wood post, thus, the solid wood materials is prevented from being used and there are some advantages of protecting environment and low cost, in addition, mechanized volume production may be realized for the post walls of the hollow post body, and the post body is light in total, which may satisfy the requirement of mass production and is convenient for transmission and mounting.

The object of the invention may also be realized by using the following technical measure.

As a more particular solution, all the post walls constituting the post are made of one piece of fiber plate. On the surface of the fiber plate, at least one V-shaped groove extending along the direction of its height is formed, the V-shaped groove divides the fiber plate into several post walls, and the respective post wall is turned over inward along the V-shaped groove to form the hollow post. One-step integral moulding may be realized for the above described fiber plate with V-shaped grooves by machining, which improves the production efficiency and may guarantee suitable shape and size of the various post walls in order to accord with the installation requirement and decrease the process difficulty of the production and mounting, which may markedly improve the rate of finished products.

On the upper side and lower side of the fiber plate, positioning grooves are set along the direction of its width. The positioning grooves are perpendicular to the V-shaped groove. A connector is embedded in each of the two ends of the hollow post composed of various post walls after tuned over. The base of the connector is embedded in the positioning groove for defining the position of the connector, which may prevent the connector from shifting or falling and ensure fixity of the position of the connector.

As a more particular solution, the connector may be a plastic connector with a screw connecting hole therein, a boss is set on the external surface of the bottom of the plastic connector which is embedded in the positioning groove within the post cavity through the boss on its external surface of the bottom.

As various embodiments of the post cavities, the post may be composed of two (arc) post walls which form a hollow post body with a circular cavity; or the post may be composed of three (plane) post walls which form a hollow post body with a triangle cavity; or the post may be composed of four of five (plane) post walls which form a hollow post body with a quadrate or polygonal cavity; and the outline of the connector matches the shape of the cavity of hollow post body.

The invention has the beneficial effects as follows.

(1) In the invention, the post for the combined light fitting is made of at least two post walls (relatively thin in thickness), which forms a hollow post body, instead of the solid wood post, and a screw connecting hole for connection with outside is installed in the end of the hollow post body, which makes it possible for people to connect two or more hollow post bodies together through bolts, this can satisfy the requirement of the light fitting for use in different heights and completely replace the solid wood post, thus, the solid wood materials is prevented from being used and there are some advantages of protecting environment and low cost, in addition, mechanized volume production may be realized for the post walls of the hollow post body, and the post body is light in total, which may satisfy the requirement of mass production and is convenient for transmission and mounting.

(2) Furthermore, in this hollow post body used for the light fitting, several (vertical) V-shaped groove are formed on the surface of one piece of fiber plate, in order for the respective post wall to turned over inward along the V-shaped groove to form the hollow post, which may define the position of the connector with the cooperation of the (transverse) positioning grooves on the upper side and lower side of the fiber plate for the outside connection, in such a manner, a preferred embodiment of the invention be realized. One-step integral moulding may be realized for this fiber plate by machining, which improves the production efficiency and may guarantee suitable shape and size of the various post walls in order to accord with the installation requirement and decrease the process difficulty of the production and mounting, which may markedly improve the rate of finished products.

(3) Since the hollow post body is composed of fiber plates, various graphics, colors, etc. may be designed on the surface of the fiber plate in use according to the design requirement, which makes the post more beautiful in appearance.

DETAILED DESCRIPTION OF THE EMBODIMENTS

Figure 1:
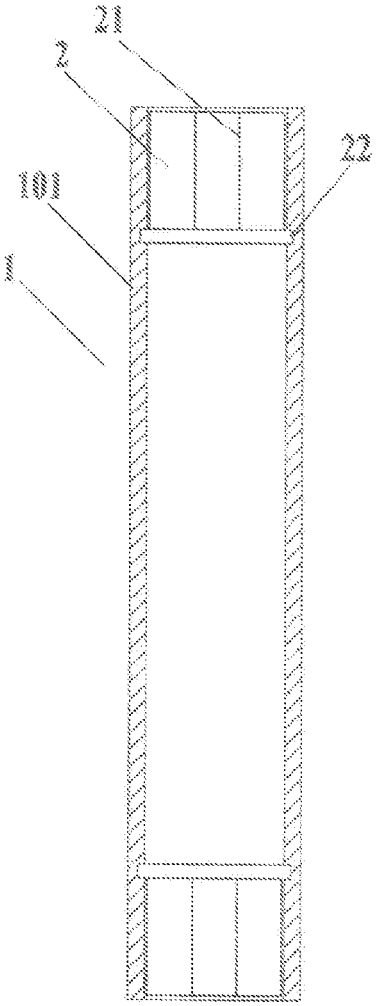
FIG. 1 is a sectional view of the post for the combined light fitting according to the invention.

As shown in FIG. 1, the post 1 is composed of four post walls 101 which form a hollow post body with a quadrate cavity. Connectors 2 are installed in both ends of the post body, and the connector 2 is provided with a screw connecting hole 21 for connection with outside.

Figure 3:
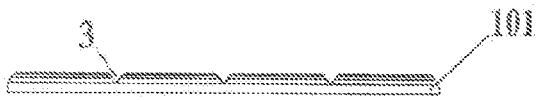
FIG. 3 is a bottom view of the FIG. 2.
Figure 2:
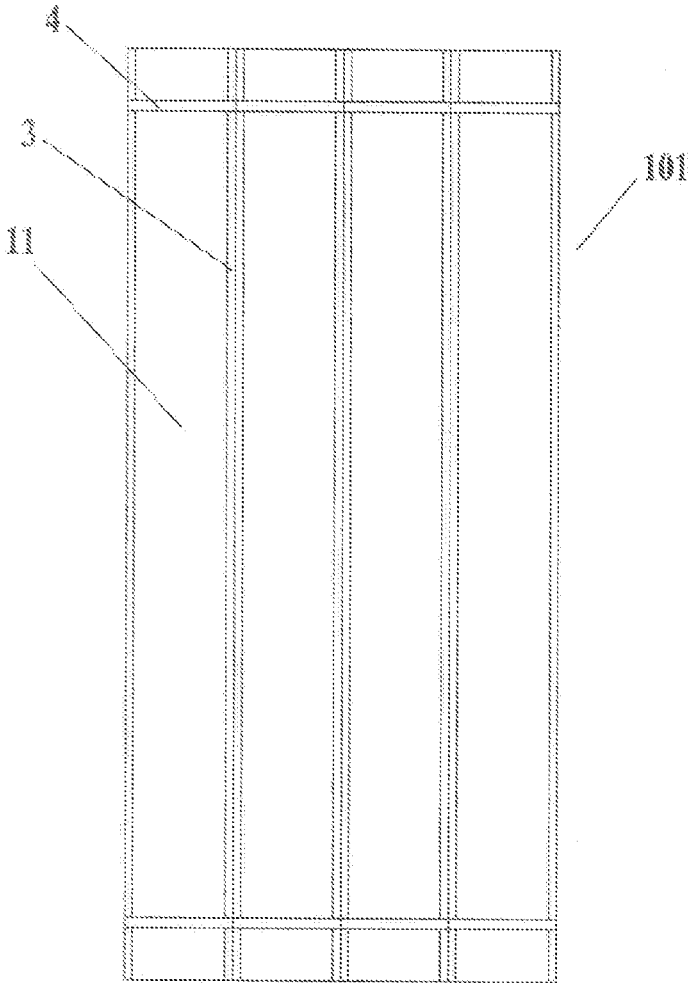
FIG. 2 is schematic diagram illustrating the unfolding state of the fiber plate of the post shown in FIG. 1.
Figure 5:
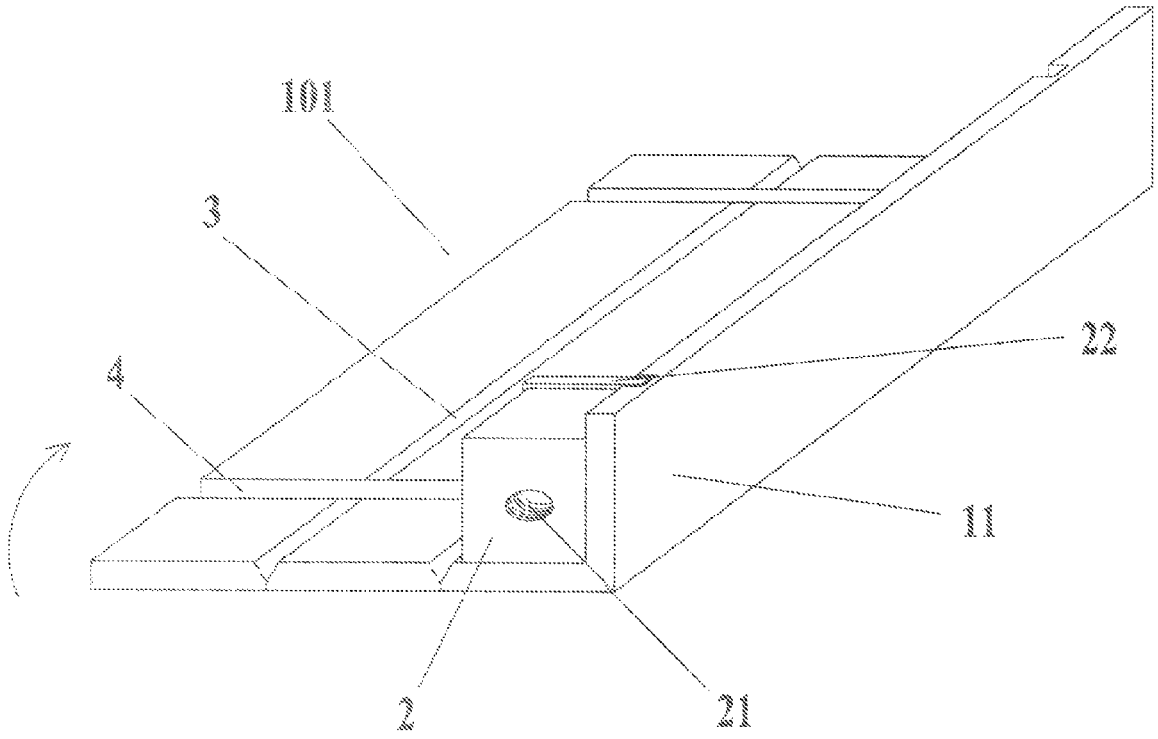
FIG. 5 is a schematic diagram illustrating that the fiber plate shown in FIG. 2 forms one post wall.

As shown in FIGS. 2, 3 and 5, four post walls 101 which constitute the post 1 are made of one piece of fiber plate 11. On the surface of the fiber plate 11, at least one V-shaped groove 3 extending along the direction of its height is formed, the V-shaped groove 3 divides the fiber plate 11 into several post walls 101, and the respective post wall 101 is turned over inward along the V-shaped groove 3 to form the hollow post 1.

On the upper side and lower side of the fiber plate 11, positioning grooves 4 are set along the direction of its width. The positioning grooves 4 are perpendicular to the V-shaped groove 3. A connector 2 is embedded in each of the two ends of the hollow post 1 which is composed of various post walls 101 after tuned over. The base of the connector 2 is embedded in the positioning groove 4 for defining the position of the connector 2.

Figure 4:
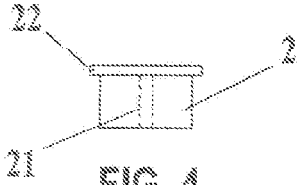
FIG. 4 is a schematic diagram illustrating the connector according to the invention.

As shown in FIG. 4, the connector 2 is a plastic connector with a screw connecting hole 21 therein, a boss 22 is set on the external surface of the bottom of the plastic connector which is embedded in the positioning groove 4 within the cavity of the post 1 through the boss 22 on its external surface of the bottom.

The post 1 may also be composed of two, three or five post walls which form a hollow post body with corresponding circular cavity, triangle cavity or polygonal cavity; and the outline of the connector 2 matches the shape of the cavity of hollow post body, the detailed description of which will be omitted.

Figure 6:
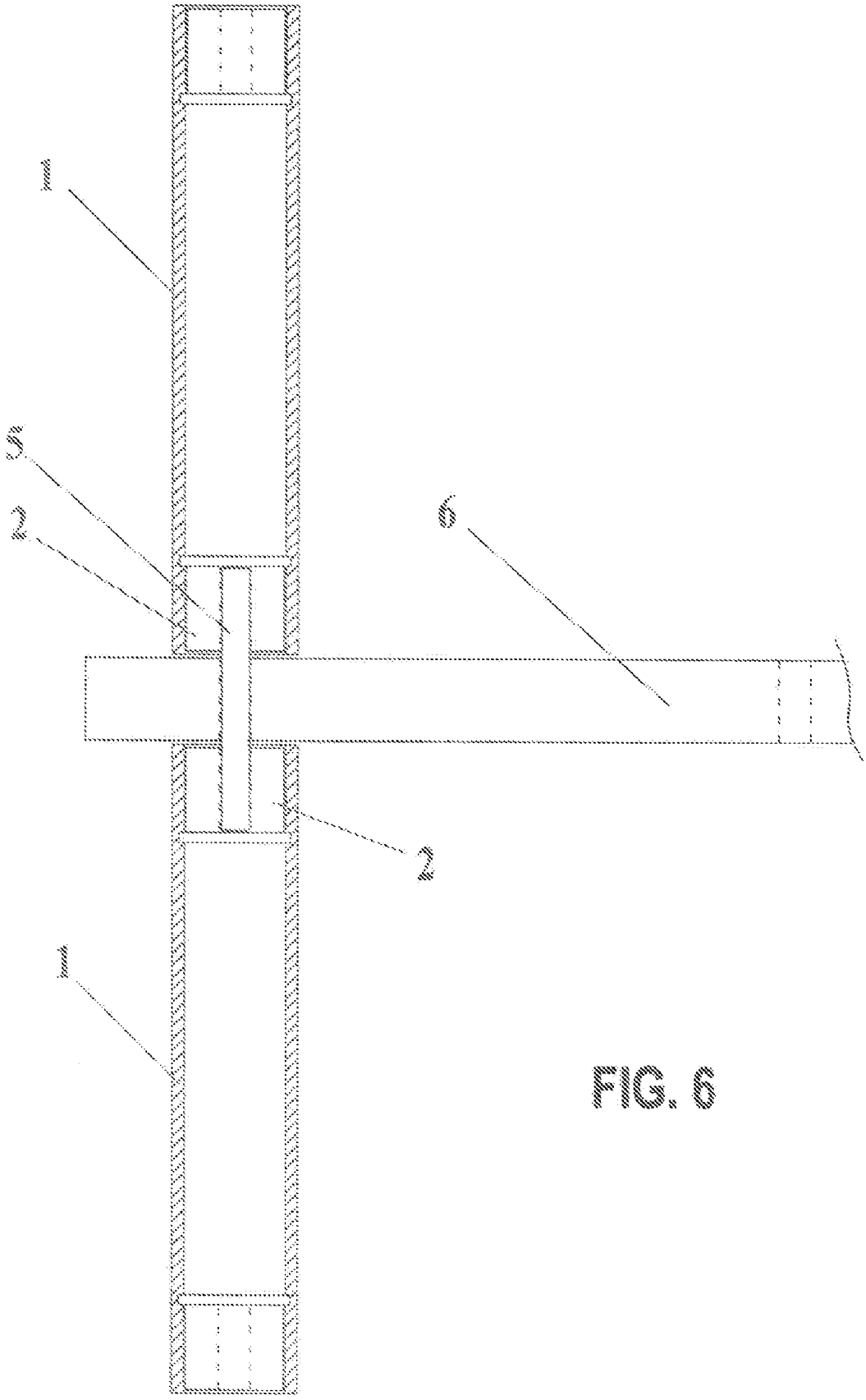
FIG. 6 is a schematic diagram illustrating the connection state of two posts according to the invention.

As shown in FIG. 6, during the assembling of the vertical combined light fitting, two hollow posts 1 according to the patent are required to be connected with each other, the solution of which may be as follows: a suited bolt 5 is used to travel through a predetermined hole on the partition board 6, each of the two ends of the bolt 5 is screwed into the screw connecting hole 21 of the connector in the corresponding end of the two posts 1, respectively, and is screwed down, thus, two posts 1 may be connected to satisfy the height requirement, and the partition board 6 may be fixed as a interlayer of the light fitting.

What is claimed is:

1. A post for a combined light fitting, comprising a post and a connector, the post being a hollow post body composed of at least two post walls, the connector installed in at least one end of the post body, the connector provided with a screw connecting hole for connection with outside, wherein all the post walls constituting the post are made of one piece of fiber plate, and on the surface of the fiber plate, at least one V-shaped groove extending along the direction of its height is formed, the V-shaped groove divides the fiber plate into several post walls, and the respective post wall is turned over inward along the V-shaped groove to form the hollow post.

2. A post for a combined light fitting, comprising a post and a connector, the post being a hollow post body composed of at least two post walls, the connector installed in at least one end of the post body, the connector provided with a screw connecting hole for connection with outside, wherein all the post walls constituting the post are made of one piece of fiber plate, and on the surface of the fiber plate, at least one V-shaped groove extending along the direction of its height is formed, the V-shaped groove divides the fiber plate into several post walls, and the respective post wall is turned over inward along the V-shaped groove to form the hollow post, wherein, on the upper side and lower side of the fiber plate, positioning grooves are set along the direction of its width, the positioning grooves are perpendicular to the V-shaped groove, a connector is embedded in each of the two ends of the hollow post composed of various post walls after tuned over, and the base of the connector is embedded in the positioning groove for defining the position of the connector.

3. The post for a combined light fitting according to claim 2, wherein the post is composed of two, three, four or five post walls which form a hollow post body with corresponding circular cavity, triangle cavity, quadrate cavity or polygonal cavity; and the outline of the connector matches the shape of the cavity of hollow post body.

4. A post for a combined light fitting, comprising a post and a connector, the post being a hollow post body composed of at least two post walls, the connector installed in at least one end of the post body, the connector provided with a screw connecting hole for connection with outside, wherein all the post walls constituting the post are made of one piece of fiber plate, and on the surface of the fiber plate, at least one V-shaped groove extending along the direction of its height is formed, the V-shaped groove divides the fiber plate into several post walls, and the respective post wall is turned over inward along the V-shaped groove to form the hollow post, wherein, on the upper side and lower side of the fiber plate, positioning grooves are set along the direction of its width, the positioning grooves are perpendicular to the V-shaped groove, a connector is embedded in each of the two ends of the hollow post composed of various post walls after tuned over, and the base of the connector is embedded in the positioning groove for defining the position of the connector, wherein the connector is a plastic connector with a screw connecting hole therein, a boss is set on the external surface of the bottom of the plastic connector which is embedded in the positioning groove within the post cavity through the boss on its external surface of the bottom.

* * * * *